United States Patent [19]

Ledgerwood

[11] 4,059,212

[45] Nov. 22, 1977

[54] STOCK FEEDER FOR PUNCHED STOCK

[75] Inventor: Harry James Ledgerwood, Conway, Mo.

[73] Assignee: Plessey Incorporated, Mellville, N.Y.

[21] Appl. No.: 765,358

[22] Filed: Feb. 3, 1977

[51] Int. Cl.[2] ..... B65H 17/36

[52] U.S. Cl. ..... 226/141; 226/150; 226/162; 276/167

[58] Field of Search ..... 226/141, 150, 151, 162, 226/167

[56] References Cited

U.S. PATENT DOCUMENTS

| | | | |
|---|---|---|---|
| 3,613,980 | 10/1971 | Kulig | 226/162 |
| 3,753,522 | 8/1973 | Voges | 226/150 X |
| 3,937,379 | 2/1976 | Narwid | 226/150 |

*Primary Examiner*—Richard A. Schacher
*Attorney, Agent, or Firm*—James J. Burke

[57] ABSTRACT

A stock feeder particularly adopted for feeding narrow, prepunched strip, and featuring a positive locator/stock holder assembly. The stock feeder positively pilots and feeds the stock with more force, and is more compact and less expensive to build, than comparable feeders. Operation is entirely pneumatic. Holding pilots and feed pilots assure positive and accurate feeding.

8 Claims, 5 Drawing Figures

STOCK FEEDER FOR PUNCHED STOCK

BACKGROUND OF THE INVENTION

The present invention relates generally to stock feeders, and, more particularly, it relates to machines for feeding coils of pre-punched stock into metal-forming equipment such as a stamping or punching press.

A large variety of transfer machines have heretofore been employed for feeding sheet or strip material into forming equipment. Perhaps the simplest involve a pair of feed rolls which engage the stock. Because the stock is smooth and generally oil-coated, however, slippage was a problem, particularly where, as was generally the case, the feed rolls had to provide the power to uncoil the stock and, optionally, pull it through a stock-straightening device.

More recently, machines with travelling edge-grippers have been used. On the forward stroke, the grippers, which may be mechanical, pneumatic or hydraulic, advance the stock a predetermined distance. As the hold of the travelling grippers is relaxed at the end of the stroke, a pair of stationary grippers is actuated which holds the stock during the forming operation, which is co-incident with the return stroke of the travelling grippers. Such machines perform well, but are large, relatively complex and expensive. Such a machine is described in U.S. Pat. No. 3,753,522.

Other prior art feeders are particularly adapted for particular types of stock or to meet particular problems. In U.S. Pat. No. 3,438,557, the grippers are allowed to float laterally, so that camber in the stock will not cause binding in the machine. Vertically floating gripper jaws are disclosed in U.S. Pat. No. 3,735,907, particularly adapted for angle stock, to accommodate bowed (e.g., non-straight) stock.

The availibility of strip stock with precisely-spaced indexing holes makes possible simpler, less expensive and more powerful feeders, as exemplified by the present invention.

OBJECTS OF THE INVENTION

It is a general object of the present invention to provide an improved feeder for pre-punched stock.

Another object of this invention is to provide a stock feeder that is less expensive to build and maintain than feeders heretofore available.

A further object of this invention is to provide a feeder that is more compact than feeders heretofore available for transfer of comparable stock.

Yet another object of this invention is to provide a feeder that is more powerful than comparable feeders.

A still further object of this invention is to provide a feeder for prepunched stock that positively pilots, feeds and holds the stock, and is therefore more accurate than comparable feeders.

Various other objects and advantages of this invention will become clear from the following description of a preferred embodiment thereof, and the novel features will be particularly pointed out in connection with the appended claims.

THE DRAWINGS

Reference will hereinafter be made to the accompanying drawings, in which.

DESCRIPTION OF EMBODIMENTS

The Invention will be described with reference to a feeder adapted to simultaneously feed two strips of pre-punched stock, though it will be appreciated that it is not so limited. For example, the invention is also adapted to feed a single, broader strip having parallel index holes on each side, or other configurations.

Figure 1:
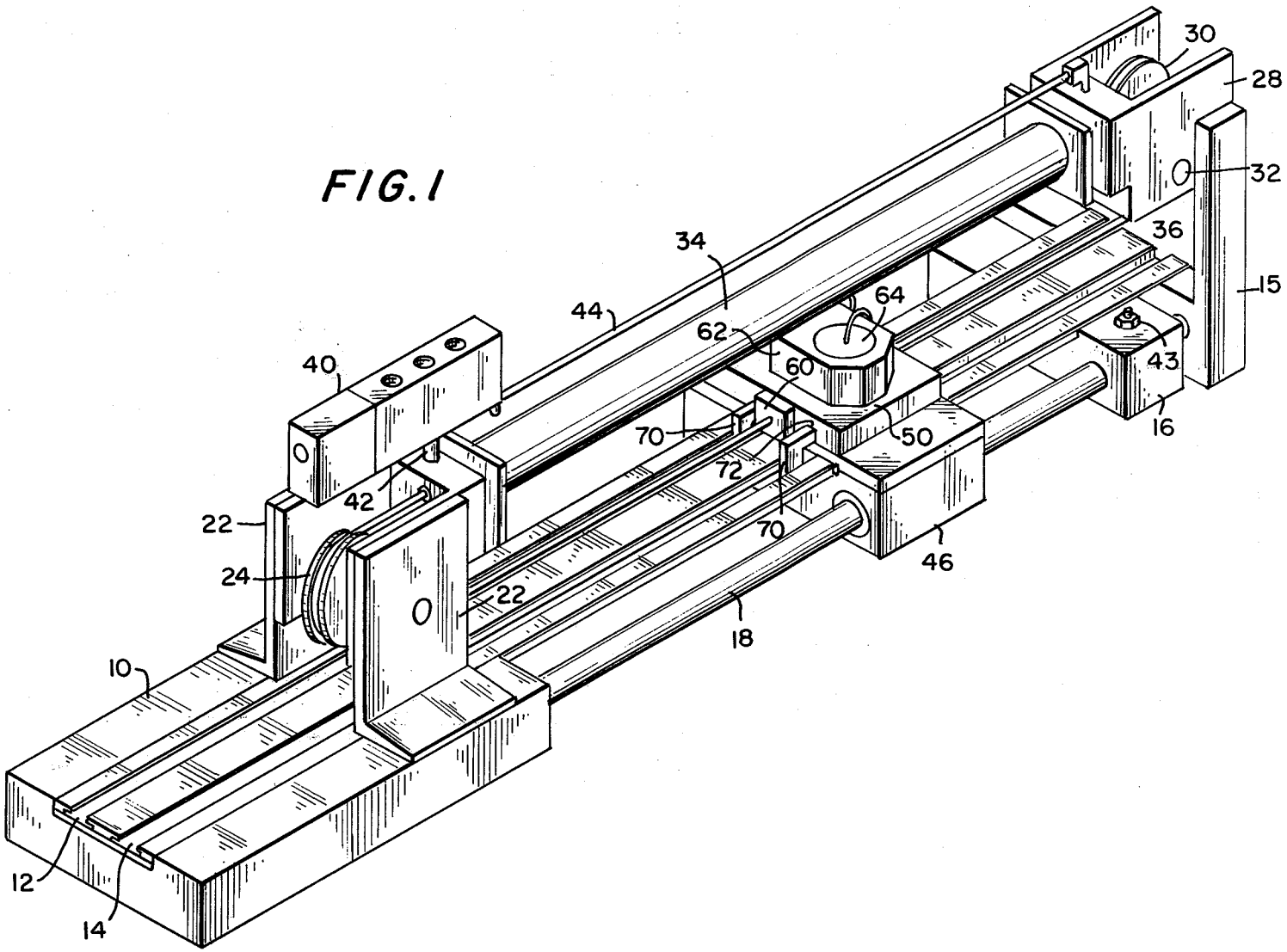
FIG. 1 is a perspective view of the preferred embodiment, showing the general arrangement of parts.

With reference to FIG. 1, the feeder of the present invention comprises a main mounting block 10 adapted to be secured to the bed of the forming machine (not shown), and having on its upper surface a pair of parallel longitudinal stock feeding tracks 12, 14, which extend the entire length of the feeder. The positive locator assembly (FIG. 2) is also on block 10 but is not visible in FIG. 1.

The rear or stock-inlet end of the machine is defined by a rear stabilizer bar 15 to which the rear end of tracks 14, 16 are also secured, and a stop block 16. Structural integrity between blocks 10 and 15 is provided by a pair of guide rails 18 (one shown), which also support the travelling feed block assembly, indicated generally at 20, and stop block 16.

Figure 3:
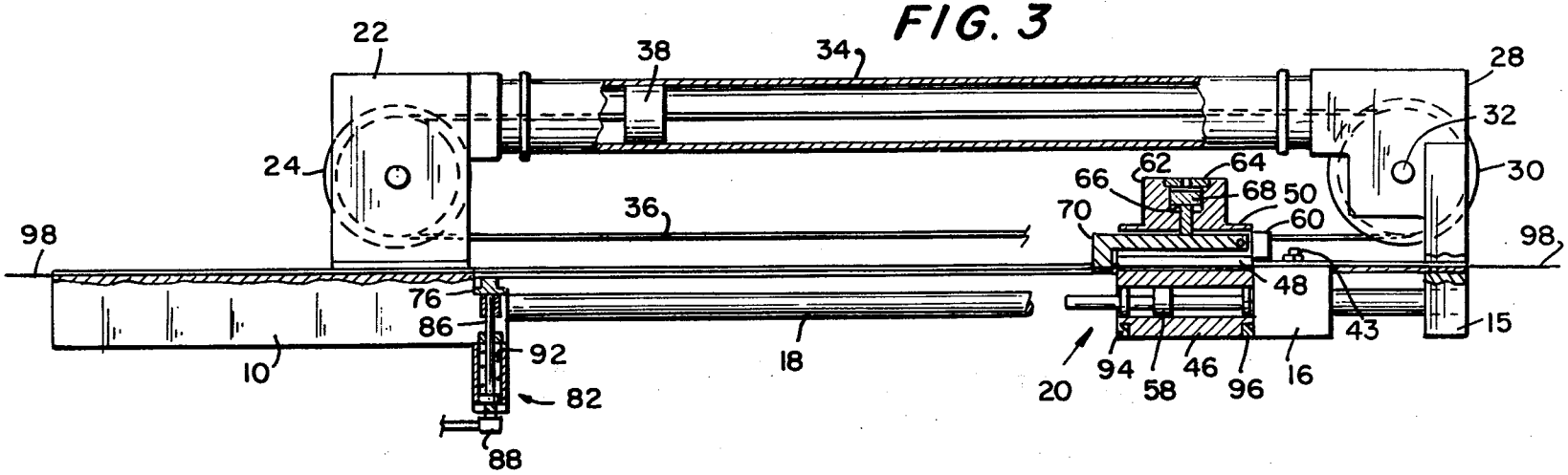
FIG. 3 and FIG. 4 are elevation views, partly in section, showing in simplified form the feed block assembly and illustrating operation of the device.
Figure 4:
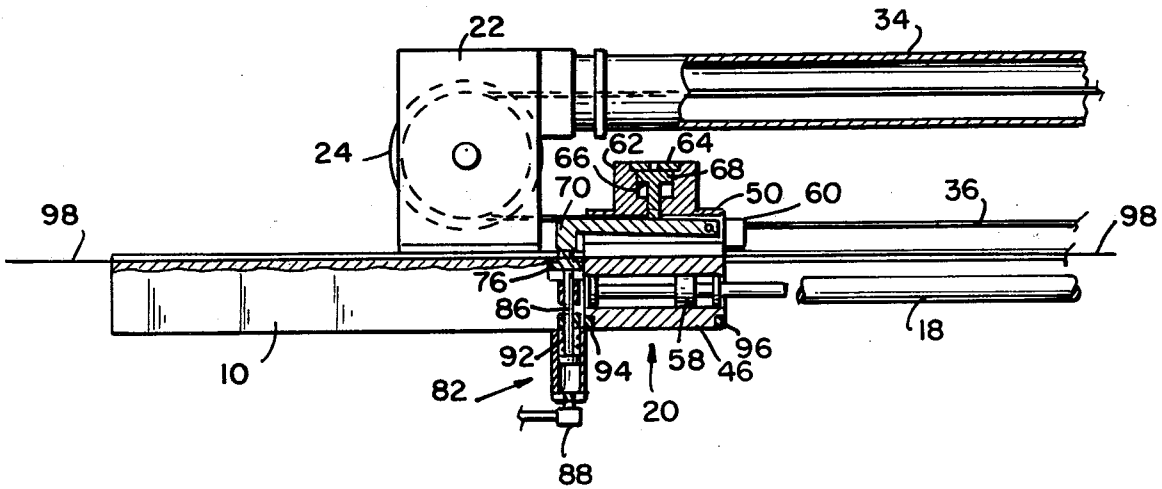

Movement of feed block 20 is effectuated with a cable and pulley arrangement. More particularly, a pair of upstanding brackets 22 on block 10 support a vertical pulley 24 on shaft 26. Similar brackets 28 on bar 15 support a second pulley 30 on shaft 32. Disposed between brackets 22, 28 and extending longitudinally over and parallel to tracks 12, 14 is pneumatic cable cylinder 34. Thus, cable 36 extends around pulleys 24, 30, through cylinder 34, where it is secured to a piston (38, in FIGS. 3 and 4). Along its lower length, cable 36 is secured to feed block 20. Thus, it can be seen that actuation of cylinder 34 to move piston 38 in one direction is effective to move feed block 20 along guide rails 18 in the opposite direction.

As shown in FIG. 1, an air valve assembly 40 is secured to bracket 22, and includes air pipes 42 and 44 for supplying compressed air to, respectively, the forward and rear ends of cylinder 34. It will be appreciated that valve 40, described in more detail hereinbelow, need not be mounted on the feeder, but could be remote therefrom, connected to it by suitable hoses.

Feed block assembly 20 comprises a slide block 46, a cable attaching plate 48, and a feed pilot block 50.

Slide block 46 has a recess 52 in its upper surface to accommodate tracks 12, 14, and apertures 54 with linear bearings (bushings) 56 for guide rails 18. As seen only in FIGS. 3 and 4, slide block 46 also includes a centrally disposed hydraulic piston and rod assembly 58, which acts as a shock absorber.

Cable plate 50 includes forward and rear cable securing brackets 60 to which cable 36 is attached.

Feed pilot block 50 includes a piston housing 62 of which only cylinder cover plates 64 can be seen in FIG. 1. As shown in cross-section in FIGS. 3 and 4, a cylinder 66 beneath plates 64 contain piston assemblies 68. A pair of pivoted feed pilot arms 70 are mounted below the respective pistons 68 in slots 72, and a spring detent (not shown) holds arms 70 in a raised position except when forced downwardly by pistons 68.

Figure 2:
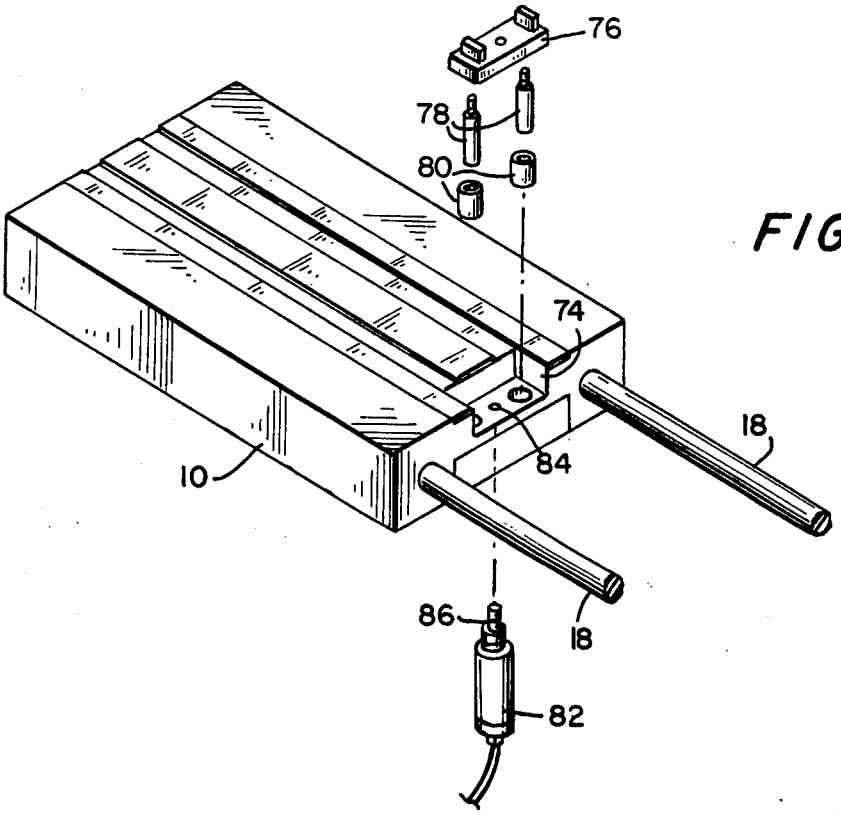
FIG. 2 is an exploded perspective view of the positive locator assembly.

The locator/holder assembly is illustrated in FIG. 2 and attention is directed thereto. A recess 74 in the rear side of block 10 contains a holding pilot block 76 which is supported by a pair of guide pins 78 for vertical movement in bushings 80 mounted in the floor of recess 74. A pneumatically actuated holding pilot piston assembly 82 is secured to the bottom of block 10 directly beneath pilot block 76 and communicates therewith via aperture 84. A rod 86 extends normally to the surface of recess 74, but when piston assembly 82 is actuated, raises pilot block 76 to a stock-engaging positions. As seen more clearly in FIGS. 3 and 4, assembly 82 includes an air inlet 88, piston 90, and a spring 92 to normally bias rod 86 in the lower or inactive position.

For operation with a variable stroke, it is desirable that rear block 16 be slidable along and engageable to guide rails 18, as by bolts 93, and that operation be controlled by microswitches 94, 96 located in the forward and rear walls, respectively, of slide block 46. However, other arrangements are possible.

With rear block 16 positioned for desired stroke length (as dictated by index holes in the stock), feed block 20 is abutted thereagainst. Lengths of stock 98 are then (hand) fed into tracks 12, 14, through recess 52 in guide block 46 until index holes are located below feed pilot arms 70. The feeder is now ready for operation, and it will be noted that, with feed block 20 in the position shown in FIG. 3, switch 94 is open and switch 96 is closed.

Starting of the feed operation is normally interlocked with the downward stroke of the press ram or punch, so that stock 98 is positioned for forming just as the ram arrives. With switch 96 closed, actuating the press first opens a valve in valve assembly 40 to energize piston 68, so that feed pilot arms 70 engage the index holes. Immediately thereafter, a valve in assembly 40 opens to pass air through conduit 42 and move piston 38 from, approximately, the position shown in FIG. 3 to that shown in FIG. 4, e.g., right to left. Feed block 20 moves in the opposite direction on guide rails 18. Suitable relays lock-in the valves in these positions as block 20 moves away from block 16, and switch 96 opens.

When feed block 20 hits the rear wall of main block 10, a similar two-step sequence ensues, commencing with closure of switch 94. First, piston 68 is de-energized and, simultaneously, piston 90 is energized. Thus feed pilots 70 and rod 86 are raised, and the stock 98 is securely held in position. While forming of the stock takes place and the ram is raised, air pressure in cylinder 34 is reversed, and feed block 20 returns to its starting position. Again, relays lock-in the valves in the proper positions until switch 96 is again closed. In addition to the functions noted above on the latter event, piston 90 is released simultaneously with pressurizing of piston 68.

Figure 5:
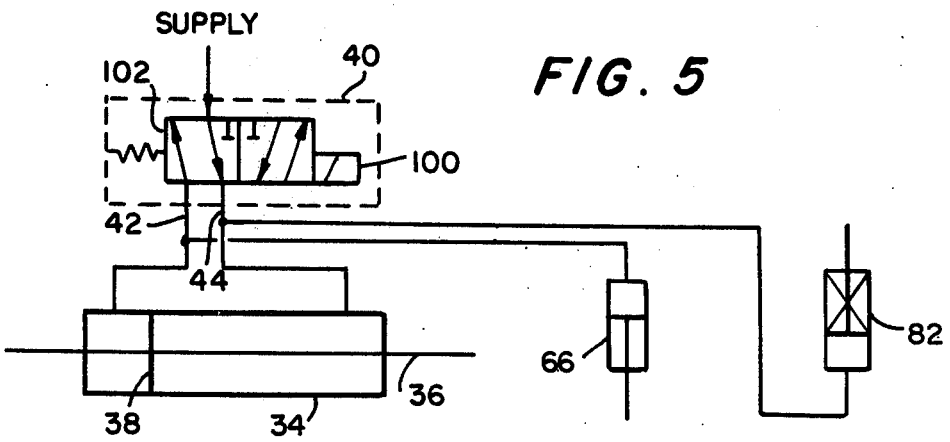
FIG. 5 is an electro-penumatic circuit diagram for one embodiment of the invention.

A simple valving arrangement suitable for use with the invention is illustrated schematically in FIG. 5, and attention is directed thereto. Thus, valve body 40 has one inlet and two outlets, and is energized by a single, spring-biased solenoid 100. The single valve core 102 has four passages for (a) alternately connecting a supply to one end or the other of cylinder 34, and (b) alternately pressuring and exhausting pistons 66 and 82. Passages controlling the latter functions are slightly larger than those controlling the former, so that the respective pilots engage and/or disengage just prior to initiation of feed block travel in either direction. Any standard 4-way single solenoid spring return pneumatic value is satisfactory (e.g., Miller No. 403 - 502 - 635 - VAC). However, it is to be noted that other types of valving arrangements may be used, and that the schematic arrangement of FIG. 5 is to be considered exemplary only. Also, limit switches 94, 96, may be mounted on the respective and blocks 10, 16 rather than feed block 20.

The stock feeder of the invention accomplishes all of the objects set forth hereinabove. It is more versatile than available equipment: feed force is varied by changing the size of cylinder 34, speed is varied with air pressure, and the device is equally well adapted to pull or push stock through a die. A larger cylinder is particularly desirable if the stock must be pulled through a straightener. By eliminating side grippers, feed rolls and the like, and locating drive means above the track, the unit is both shorter and narrower than available feeders. All parts are standard items, readily available "off the shelf," so manufacturing costs are reduced.

Various other changes in the details, steps, actuation means and arrangements of parts, which have been described and illustrated herein to explain the nature of the invention, may be made by those skilled in the art within the principle and scope of the invention as defined in the appended claims.

What is claimed is:

1. A stock feeder for moving indexed or pre-punched stock comprising:

track means for supporting said stock as it moves through said feeder;

a mounting block at the forward end of said track;

a rear block and stabilizer bar at the rear end of said track;

guide rails supported between said mounting and rear blocks;

a feed block assembly movably supported on said guide rails; and including feed pilot means for engaging index holes from one side of said stock;

holding pilot means in said mounting block adapted to engage index holes from the other side of said stock;

fluid-actuated piston and cylinder means spaced from and parallel to said guide rails, and including pulley and cable means operably secured to said feed block assembly and said piston means; and actuating means to (a) engage said feed pilot means and disengage said holding pilot means at the beginning of a stroke. (b) actuate said piston means to move said feed block assembly along said rails, advancing said stock, (c) disengage said feed pilot means and engage said hold pilot means at the end of a stroke, and (d) actuate said piston means to return said feed block assembly to said starting position.

2. The stock feeder as claimed in claim 1, wherein said rear block is adjustable along said guide rails, whereby stroke length is varied.

3. The stock feeder as claimed in claim 1, and further including bracket means on said mounting block and said stabilizer bar, said piston and cylinder means being supported therebetween, said brackets also supporting said pulley means.

4. The stock feeder as claimed in claim 1, wherein said feed pilot means includes fluid-actuated piston means in communication with pivoted feed pilot arm means, said arm means being biased in the disengage position.

5. The stock feeder as claimed in claim 1, wherein said holding pilot means includes fluid-actuated piston means in communication with vertically-slidable holding pilot arm means, said piston being biased in the disengage position.

6. The stock feeder as claimed in claim 1, wherein said actuating means includes limit switch means opened or closed at the ends of said stroke by said feed block assembly.

7. The stock feeder as claimed in claim 6, wherein said actuating means includes solenoid actuated fluid control valve means adapted to carry out functions (a) and (b) at a first position, and to carry out functions (c) and (d) at a second position, said solenoid being actuated by said limit switch means.

8. The stock feeder as claimed in claim 7, wherein said valve means is adapted to carry out function (a) just before function (b), and to carry out function (c) just before function (d).

* * * * *